US005816724A

United States Patent [19]

Hada et al.

[11] Patent Number: 5,816,724

[45] Date of Patent: Oct. 6, 1998

[54] PLATEN AND PRINTER

[75] Inventors: Toshiki Hada, Fujisawa; Hiroyuki Takenoshita, Sagamihara; Tsutomu Sawa, Fujisawa, all of Japan

[73] Assignee: International Business Machines Corporation, Armonk, N.Y.

[21] Appl. No.: 864,292

[22] Filed: May 28, 1997

[30] Foreign Application Priority Data

Jun. 18, 1996 [JP] Japan ..... 8-156783

[51] Int. Cl.[6] ..... B41J 11/08

[52] U.S. Cl. ..... 400/656; 400/648

[58] Field of Search ..... 400/656, 648, 400/662

[56] References Cited

U.S. PATENT DOCUMENTS

| | | | |
|---|---|---|---|
| 2,873,838 | 2/1959 | Metzner | 400/656 |
| 4,318,452 | 3/1982 | Reitner | 400/656 |
| 4,327,366 | 4/1982 | Schafter et al. | 400/656 |
| 4,929,106 | 5/1990 | Buan et al. | 400/656 |
| 4,957,382 | 9/1990 | Delaney et al. | 400/656 |
| 4,984,917 | 1/1991 | Hauslaib et al. | 400/656 |
| 5,090,825 | 2/1992 | Merriman, Jr. et al. | 400/656 |
| 5,168,803 | 12/1992 | Kunz et al. | 400/656 |

FOREIGN PATENT DOCUMENTS

| | | | |
|---|---|---|---|
| 2844514 | 4/1979 | Germany | 400/656 |

*Primary Examiner*—Edgar S. Burr
*Assistant Examiner*—Amanda B. Sandusky
*Attorney, Agent, or Firm*—Romualdas Strimaitis; R. Bruce Brodie

[57] ABSTRACT

In the present invention, the platen bar is compositely formed of three materials. For a sole layer, a material is used which has high hardness and strength, and has a property that the repulsion against the impact of the print wires is large. For an elastic layer, a material is used which transmits less vibration to the platen base in the print operation and absorbs the impact when the wires of a printhead strike the sole layer. For platen bases, a material is used which has a very high hardness, a high molding precision, and less dimensional change due to temperature change or change with time. The elastic layer is exposed on the surface and a gap roller is positioned at the exposure location. With this, the occurrence of the dent by the gap roller can be prevented when the printing on a copy form is performed.

6 Claims, 5 Drawing Sheets

PLATEN AND PRINTER

FIELD OF THE INVENTION

The present invention relates to a mechanism for supporting a processing medium, such as a paper sheet, when a processing accompanied by impact is performed to the processing medium, and particularly to a platen for use with an impact printer, and a printer using the platen.

BACKGROUND OF THE INVENTION

In impact-type printers which are currently in widespread use, the wires of a printhead strike an ink ribbon against a printing medium (a medium upon which is printed, including forms such as various forms and passbooks) to transfer the ink impregnated to the ink ribbon to the printing medium (in a duplicate, mainly the sandwiched carbon paper or noncarbon paper is caused to develop a color by the printing pressure of the wires), thereby performing printing. A platen is provided for receiving the impact of the printhead wires and supporting the printing medium. This platen is required to have the following characteristics:

1. That it have a surface which is smooth and uniform, does not change with time, and has a long life (preferably, 10 years or longer).
2. That it does not deform even if being continuously struck by the wires of the print head.
3. That it generates a sufficient repulsion when struck by the wires. (If the repulsion is not enough, the printing may become unclear, or the ink ribbon may move before the wires return to cause the wires to catch in the ribbon, leading to a failure.)
4. That it absorbs the impact to some extent when struck by the wires. (If the impact is not sufficiently absorbed, the life of the ink ribbon is shortened, and the printing is blurred when a new ink ribbon is used to perform the printing on a printing medium having a small thickness.)
5. That it generates little noise and vibration in the printing operation.
6. That it has a structure which generates no concentration of stress and shear force in the printing medium if the printing medium is put between it and a printing medium fixing member to be described later. (A copy form is used as the printing medium in the impact printer since the printing is performed using the impact of the printhead wires but, if a concentration of stress or shear force occurs in the portion of the printing medium which is sandwiched between the platen and the printing medium fixing member then, in the duplicates, a horizontal line or the like is unnecessarily copied in that portion.)
7. That it does not prevent the transportation of the printing medium.
8. That it is easily machined and inexpensive.
9. That the main body of the platen is lightweight. (If the main body of the platen is not fully made lightweight in the platen assembly having a lift mechanism for the platen to be described later, the traceability of the platen main body to the lift mechanism is degraded.)

For conventional impact printers, steel, aluminum alloy, or rubber is used as the platen material - none of which satisfies all of the above requirements. Moreover, a material is selected by sacrificing some characteristics, depending on the application of the printer. As a general rule, for applications in which durability and low cost are objectives, a material having an aluminum alloy surface applied with a hard anodized aluminum processing is used. However, the hardness of an aluminum alloy is low and there is a disadvantage that, if a large quantity of thin sheets of paper are printed, the surface may degrade and damage the print quality and noise problems also occur. On the other hand, an elastic material such as rubber is selected if low noise is an objective, but the change over time and the degradation due to the impact of the printhead wires is great; if such a material is used for the platen surface, the platen must be replaced several times during the life of the printer. In addition, the return of the printhead wires becomes slow and the ink ribbon moves before the wires return, which leads to a high possibility that the wires may catch in the ink ribbon. Thus, to solve this problem, the print speed should be slowed down.

In connection with such problems in the platen of a printer, Japanese Published Unexamined Utility Model Application No. 58-140743, and Published Unexamined Patent Application Nos. 64-42265 and 64-58572 disclose a platen roll of a three-layer structure in which a material for preventing vibration or a sound-deadening member is inserted between the core material and the annular covering material. Such a technique solves one of the above problems to the extent that it generates less noise and vibration in the printing operation. However, the annular covering material has a cylindrical shape and does not provide a structure in which the impact is absorbed by the intermediate layer, and accordingly is not a structure which satisfies the objective that it absorb impact to some extent when being struck by the wires.

Further, Japanese Published Unexamined Patent Application Nos. 64-42265 and 64-58572 disclose a supporting plate for a belt-type printer in which an abrasion-resistant plastic composite material containing carbon fibers as the main base material is provided on the surface of the main body of the supporting plate made of plastic. Such a technique solves one of the above problems to the extent that it does not deform when being continuously struck by the printhead wires. However, it is not a structure which satisfies the objective that it absorb impact to some extent when being struck by the wires, and that it generate less noise and vibration during the printing operation because no elastic material is used for absorbing impact, vibration, noise, or the like.

Further, Japanese Published Unexamined Utility Model Application No. 60-62952 discloses a platen for a thermal printer in which the surface of the platen rubber is coated with a thin film which is excellent in abrasion resistance, slide resistance, and heat resistance. Such a technique is in the field of a thermal transfer printer, and it is not easy for those skilled in the art to infer the use of such a technique for impact printers. Moreover, the application of such a technique to impact printers would not solve the above problems to the extent that it does not deform, even if being continuously struck by the printhead wires since the surface of the platen rubber is coated with a thin film excellent in abrasion resistance, slide resistance, and heat resistance.

The present invention provides a platen having the above characteristics:

1. It has a surface which is smooth and uniform, does not change with time, and has a long life.
2. It does not deform even after being continuously struck by the printhead wires.
3. It generates a sufficient repulsion when struck by the wires.

4. It absorbs the impact to some extent when struck by the wires.
5. It generates less noise and vibration during the print operation.

Further, in a preferred embodiment of the present invention, a printer is provided with a platen having the above characteristic 6—that it generates no concentration of stress and shear force in the printing medium if the printing medium is put between it and a printing medium fixing member, and a mechanism for fixing the printing medium in cooperation with the platen.

Furthermore, in a preferred embodiment of the present invention, a platen is provided having characteristic 7—that it does not prevent the transportation of the printing medium.

Finally, in a preferred embodiment of the present invention, a printer is provided which comprises a platen having characteristic 8—that it is easily machined and inexpensive; and characteristic 9—that the main body of it is lightweight, and a mechanism cooperating with the platen.

SUMMARY OF THE INVENTION

As described above, in accordance with this invention, a platen is provided which has enough repulsion against the wires of the printhead, less deformation or change with time due to the effect of the impact of the printhead wires, and a long life, while maintaining the noise and vibration at low values and absorbing the impact of the printhead.

Further, in accordance with the present invention, a printer is provided which has good print quality and causes no unwanted color developments in portions other than the portions on which printing is performed when the printing on a copy form is performed.

In the present invention, by forming a composite platen bar of three materials to devise the material and structure of the platen constituting an impact printer, a platen is achieved which makes a low print sound, has a surface hard to damage by the impact of the print wires for a long period of time, and has a high coefficient of repulsion to enable clear printing.

In one aspect of the present invention, a platen is provided which has a substantially planar surface for supporting a printing medium and comprises at least three layers: a top layer, a middle layer, and a bottom layer, in this order from the surface side wherein the middle layer is formed of a material which is more elastic than the top layer and the bottom layer, and the surface comprises an inelastic surface formed of the material of the top layer and an elastic surface formed of a material which is more elastic than the material of the top layer.

This platen is formed of a material having a coefficient of friction which is lower than the material of the middle layer, further having a printing surface provided at an angle larger than 90 degrees and smaller than 180 degrees with the surface.

In accordance with another aspect of the present invention, a platen is provided which has a substantially planar surface for supporting a printing medium and comprises at least three layers: a top layer formed of a carbon fiber reinforced resin, a middle layer formed of rubber, and a bottom layer formed of a thermosetting resin, in this order from the surface side wherein the surface consists of the carbon fiber reinforced resin which is the material of the top layer, and the rubber which is the material of the middle layer.

In accordance with another aspect of the present invention, a platen is provided for supporting a printing medium in an impact printer in which the printing onto the printing medium is performed by striking the wires of a printhead, a platen having a substantially planar surface and comprising at least three layers: a top layer, a middle layer, and a bottom layer, wherein the top layer is formed of a thin plate-like member having enough hardness and strength to support the impact of the struck wires of the printhead, the middle layer is formed of a material which is more elastic than the top layer and the bottom layer, and the bottom layer is formed of a material having enough rigidity to support the top layer and the middle layer, the striking of the wires of the printhead against the top layer being absorbed by the elasticity of the middle layer to change the distance between the top layer and the bottom layer.

In accordance with another aspect of the present invention, a printer for performing the printing on a printing medium is provided, the printer comprising a platen having a substantial planar surface for supporting the printing medium, and comprising at least three layers of a top layer, a middle layer, and a bottom layer, in this order from the surface side, the middle layer being formed of a material which is more elastic than the top layer and the bottom layer, the surface comprising an inelastic surface formed of the material of the top layer, and an elastic surface formed of a material which is more elastic than the material of the top layer; a printhead positioned opposite to the inelastic surface of the platen for performing the printing on the printing medium; and a member for fixing the printing medium which is positioned opposite to the elastic surface of the platen for fixing the printing medium in cooperation with the platen. This printer may comprise a platen assembly including a platen and a lift mechanism for the platen.

In accordance with another aspect of the present invention, a printer is provided with a platen and a printer in which the print sound is low, the surface is difficult to damage even by the impact of the print wires over a long period of time, clear printing is provided by the high coefficient of repulsion, and no unwanted color developments are caused on portions other than the portions on which printing is performed when printing on a copy form is performed.

DESCRIPTION OF THE PREFERRED EMBODIMENT

Figure 1:
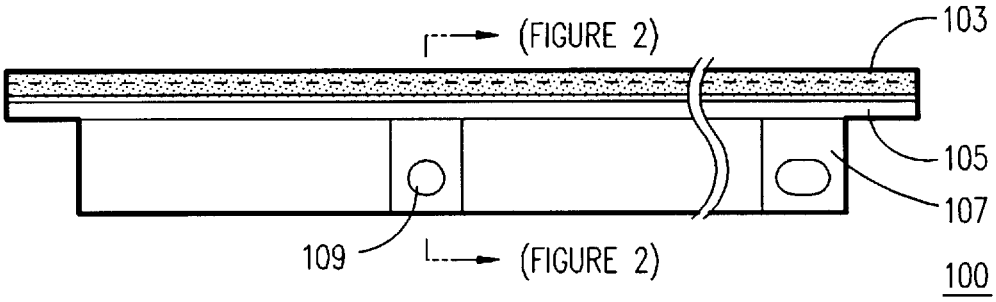
FIG. 1 shows the outward appearance of the platen which is a preferred embodiment of the present invention.
Figure 2:
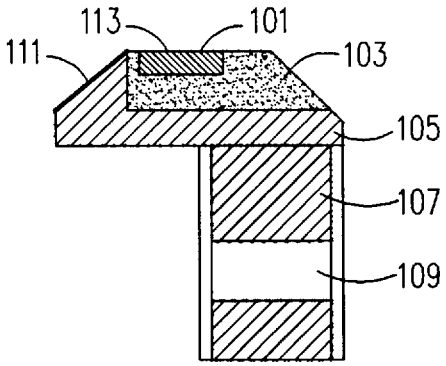
FIG. 2 is a sectional view of the platen which is the preferred embodiment of the present invention.

FIG. 1 is an external view of an embodiment of the platen in the present invention, and FIG. 2 is a sectional view of the platen. The platen shown in FIG. 2 comprises a sole layer 101, an elastic layer 103, and platen bases 105 and 107. In the platen in the preferred embodiment of the present invention, the platen bases 105 and 107 are formed of a thermosetting resin, the elastic layer 103 is provided on the platen bases 105 and 107, and on the elastic layer 103 the sole layer 101 is made of a carbon fiber reinforced resin and is bonded for receiving the impact of the head wires, and finally the necessary portions are finished by polishing. The platen bases 105 and 107 may be made by monolithic molding or by independently making the platen base main body 105 and the leg portion 107 and bonding the two.

In the preferred embodiment of the present invention, as the sole layer 101, a thin plate having a thickness of about 2 mm is used. The thin plate is formed by hardening many carbon fibers or woven carbon fibers with a thermosetting resin such as epoxy resin or vinyl ester. The carbon fiber reinforced resin has a very high hardness and strength, and the repulsion by the impact of the print wires is large. The carbon fiber reinforced resin can be replaced by materials having enough strength and hardness and having as their properties a large repulsion against the wires, such as plastics containing various reinforcing fibers such as metal fibers, boron fibers, Kevlar fibers, and glass fiber, metals such as stainless steel, various ceramics, and plastics.

For the elastic layer 103, NBR (Nitrile Butadiene Rubber) is used and it transfers less vibration to the platen base in the print operation, contributing to reducing the noise and vibration. Further, the elastic layer 103 absorbs the impact when the sole layer 101 is struck by the wires of a printhead 201 (FIG. 5), thereby preventing the occurrence of ink blurring ink or the like. The NBR can be replaced by other rubber materials such as natural rubber, urethane rubber, and silicone rubber, and other elastic materials such as soft vinyl chloride.

For the platen bases 105 and 107, BMC (Bulk Molding Compound: unsaturated polyester resin) is used. The hardness of the BMC is very high, and the size of it is less affected by a temperature change or change with time, whereby high precision and low cost are achieved. Such a composite structure actualizes a platen having a uniform and hard surface, high durability, high coefficient of repulsion, low print noise, high dimensional precision, light weight, and low price. Further, the BMC can be replaced by thermosetting resins and thermosoftening resins having high strength and rigidity (preferably, dimensional stability and chemical resistance) such as epoxy resin, phenolic resin, polyimide resin, and polyester resin, and materials having as their properties enough strength and rigidity, such as plastics containing various reinforcing fibers, metals such as stainless steel, aluminum alloys, various ceramics, and plastics. Accordingly, the sole layer 101 and the platen bases 105 and 107 may be formed of the same material, and it is not an indispensable structural element that the platen of the present invention is comprised of three different materials.

Figure 3:
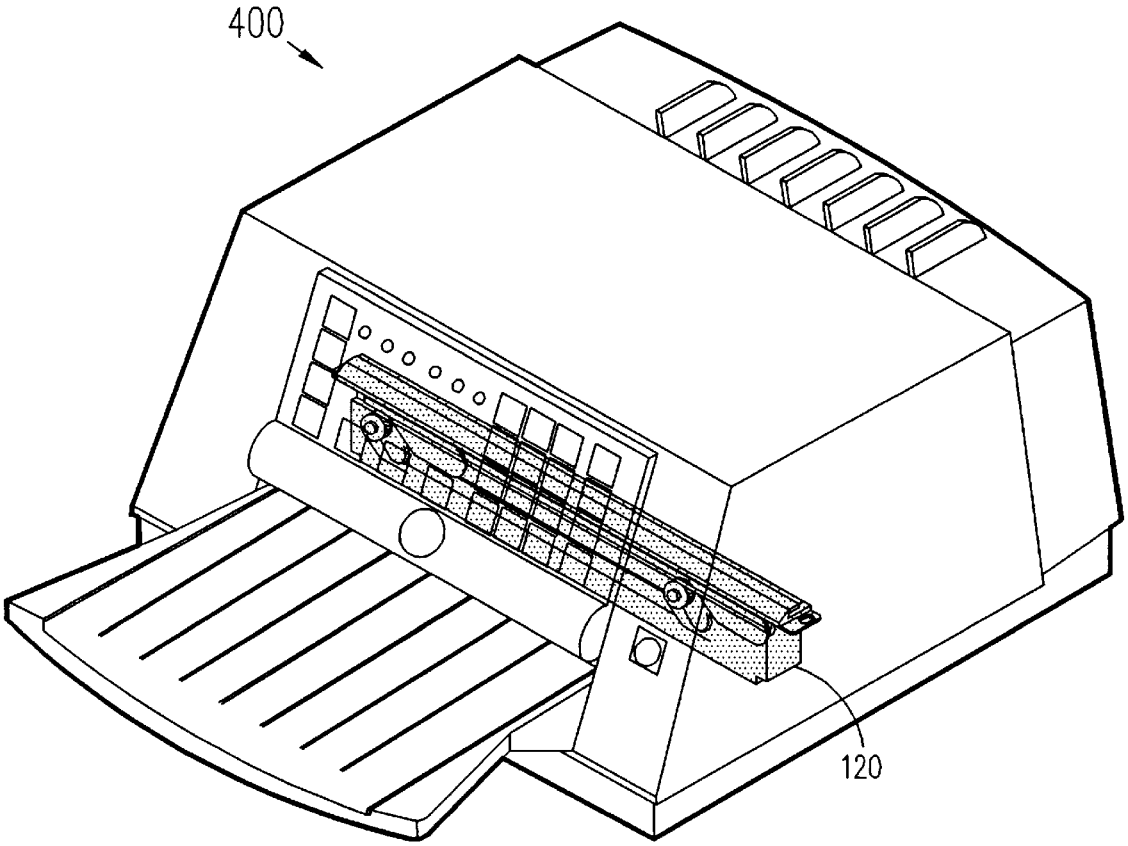
FIG. 3 shows the outward appearance of the printer which is a preferred embodiment of the present invention.

Referring now to FIG. 3, there is shown an exterior view of an impact printing apparatus 400 embodying the platen assembly 120 of the invention.

Figure 4:
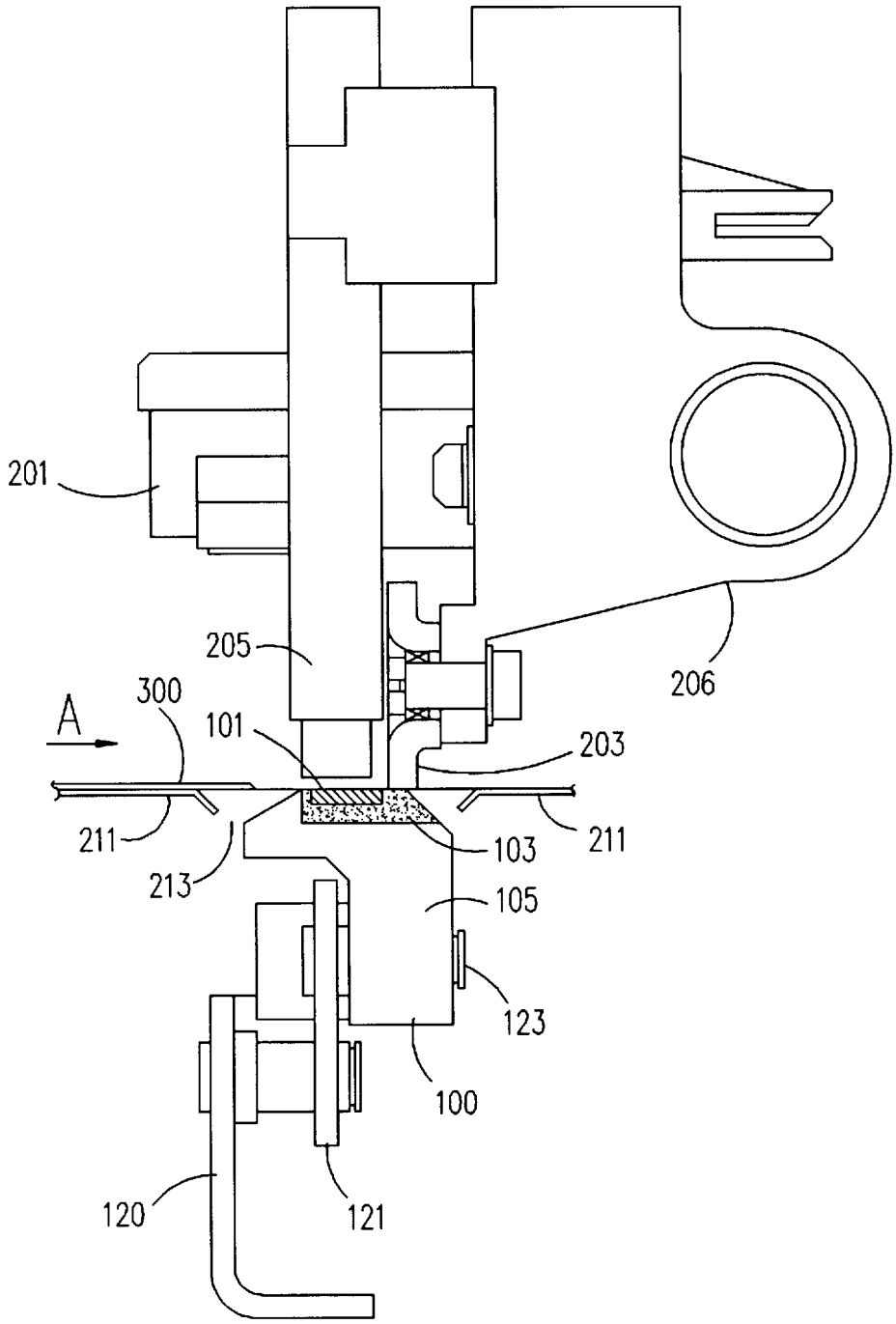
FIG. 4 is a sectional view of the main portions of the printer which is the preferred embodiment of the present invention.
Figure 5:
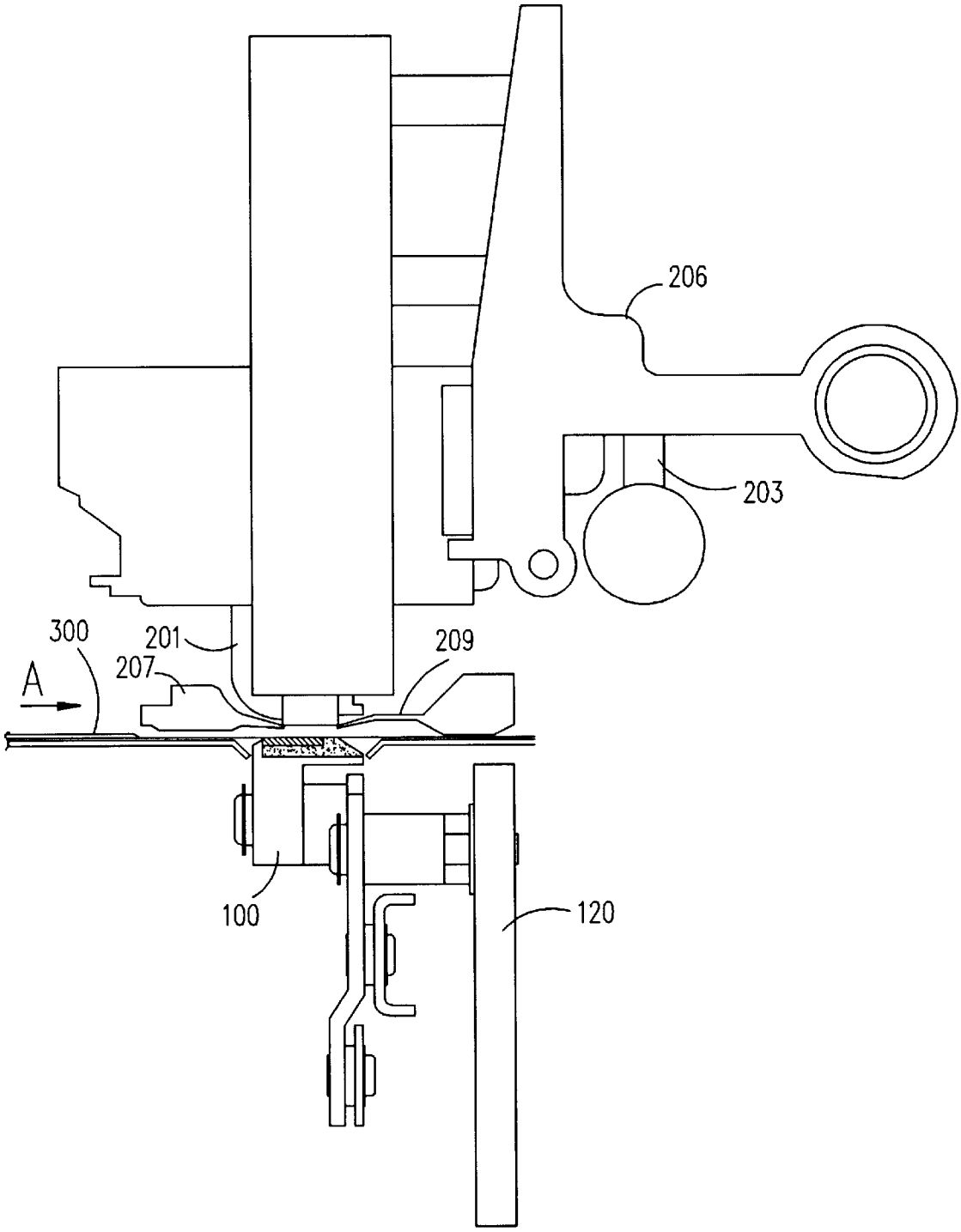
FIG. 5 is a sectional view of the main portions of the printer which is the preferred embodiment of the present invention.
Figure 6:
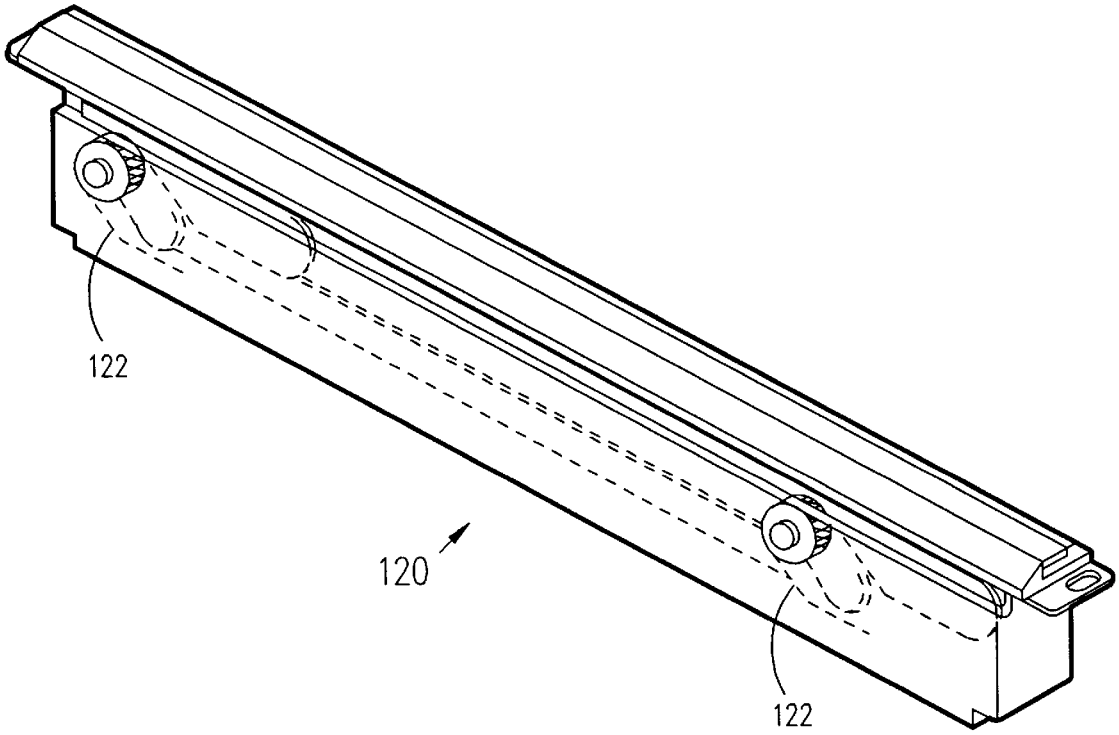
FIG. 6 shows the outward appearance of the platen assembly which is a preferred embodiment of the present invention.

FIG. 4 shows an external view of an embodiment of the printer of the present invention, and the main portions of it are shown in FIGS. 4 and 5. In FIG. 4, the platen 100 is supported by a lift mechanism 121 as a platen assembly 120. The platen assembly 120 includes a torsional spring 122 in the lift mechanism 121, as shown in FIG. 6, so that the platen 100 is able to freely rise and fall by the application of force from above and the releasing of the force. With this, the printer of the present invention can perform printing on printing media having various thicknesses. The platen 100 is connected to the lift mechanism 121 in its opening 109 for connection by a shaft 123 and a plate to form the platen assembly.

Referring to FIG. 4, a printing medium 300 (in the figure, the printing medium is a passbook of a financial institution) is transported by a transport roller (not shown) along a paper guide 211 to the print position. The printing medium 300 passes a printing medium receiving surface 111 of the platen 100 and the printing surface 113 of the platen 100. While the printing medium 300 passes, the platen 100 does not prevent its passing by falling to a position such that the printing medium 300 is not directed by the platen 100 to enter an opening 213 in the transportation path of the paper guide 211. If, during passing, the angle of the printing medium receiving surface 111 of the platen 100 relative to the printing surface 113 is too small (nearly 90 degrees) or the coefficient of friction of the printing medium receiving surface 111 is high, the probability of catching the edge of the printing medium to obstruct its passing is high.

When the printing medium 300 is transported to the print position, the platen 100 rises to a predetermined position suitable for printing. In the preferred embodiment of the present invention, the printing surface 113 of the platen 100 rises to a position higher than the paper guide 211 by about 0.5 to 2.0 mm. This is to give a "tension" to the print surface of the printing medium 300 and reduce the floating of the print surface of the printing medium 300 above the printing surface 113 of the platen, thereby reducing the air layer produced between the printing medium 300 and the printing surface 113 and preventing degradation of the print quality. Thus, although an illustrative embodiment of the printing surface 113 of the platen 100 has a substantially planar shape, it may also have the shape of a convex surface of about 20 to 50 R.

Also, a printhead 201 moves along the longitudinal direction of the platen (the direction vertical to the paper surface of FIG. 3) to print on the printing medium. A gap roller 203 attached to a carrier 206 keeps the distance between the print surface of the printing medium 300 and the printhead 201 constant and fixes the printing medium 300. The role of the gap roller 203 of keeping the distance of the printhead 201 constant is to prevent an ink ribbon 205 from being put in contact with the printing medium 300, and to allow the ink contained in the ink ribbon at the portions struck by the wires of the printhead 201 to be transferred to the printing medium 300.

The platen 100 is pushed down by the pressing of the gap roller 203, and the printing medium 300 is firmly fixed by the repulsion of the spring provided in the lift mechanism 121 of the platen assembly 120. However, under such circumstances, if the coefficient of friction of the printing medium holding surface 113 of the platen 100 is high, only a little pressing is required for fixing the printing medium 300; and, if the same pressing acts, the force for fixing the printing medium 300 is enhanced by the high frictional force (frictional force=coefficient of friction$\chi$ vertical drag). If the printing medium 300 holding surface 113 is of a material high in elasticity, the stress is reduced which affects the printing medium, and the stress concentration can also be reduced. Further, even if the concentration of stress or shear force due to the deposition of dusts or the like occurs, the stress concentration or the like due to this can be reduced. Thus, when printing is performed on a copy form, the belt-shaped color development (copy) of the roller width as a trace of the running of the gap roller 203 can be suppressed.

FIG. 5 is a sectional view showing the main portions of the printer of the present invention, as in FIG. 4, and the fixing of the printing medium 300 and the keeping of the distance between the printhead 201 and the printing medium 300 to be a constant spacing can be accomplished by a mechanism different from the above-described gap roller.

This is accomplished by two bar-shaped members which are placed so that their longitudinal directions are parallel with the longitudinal direction of the platen 100. In this specification, for the convenience of explanation of the two members, the member 207 on the side of the hole into which the printing medium is inserted is called "bar-front", and the member 209 is called "bar-back". In addition, the members like the gap roller 203, the bar-front 207, and the bar-back 209 for fixing the printing medium 300 in cooperation with the platen 100 are generically called a "printing medium fixing member".

The platen 100 presses the printing medium 300 at the side opposite to the bar-front 207 and bar-back 209 to fix the printing medium 300. Also under such circumstances, if the printing medium holding surface 113 of the platen 100 has a high coefficient of friction and is of a material high in elasticity, the printing medium can firmly be fixed; even if the concentration of stress or shear force occurs, it can be reduced. Thus, when printing is performed on a copy form, the copying (dent) due to the effect of the bar-front 207 and the bar-back 209 can be suppressed.

After the printing medium 300 is fixed in this way, printing is performed on the printing medium 300 by striking the wires of the printhead 201. Since the sole portion 101 of the platen 100 is at a position where the wires of the printhead are struck and surface 113 of the platen 100 receives the impact, a platen having high durability and high coefficient of repulsion can be achieved while maintaining the print noise and vibration at low values.

Figure 7:
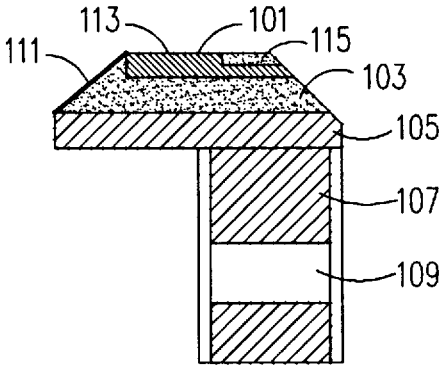
FIG. 7 is a sectional view of the platen which is another embodiment of the present invention.

Although the embodiment for implementing the present invention has been disclosed above, the technical idea of the present invention is not limited to such an embodiment, but various modifications may be made by those skilled in the art when it is implemented. For instance, the materials shown in the embodiment of the present invention can be replaced by materials having substantially the same properties. Further, the coefficient of friction may be changed by the sticking, coating, evaporating, applying, and the like of a different material. Moreover, the structure of the platen shown in FIG. 2 can also be changed. For instance, it is not necessary to expose the elastic layer 103 on the surface 113 along with the sole layer 101, but a new elastic layer 115 may be provided as shown in FIG. 7, or a material having a high coefficient of friction may be coated. Also, it is not needed to form the printing medium receiving surface 111 by the platen base 105, but an effect similar to the platen shown in FIG. 2 can also be obtained by coating the elastic layer 103 with a material having a low coefficient of friction.

What is claimed is:

1. A platen for an impact printer, said platen having a planar surface for supporting a print medium and comprising at least three contact layers including a top, middle, and bottom layer, said layers providing a mass tuned to energetically absorb repeated impacts from a print head applied to the planar surface through the print medium, said medium being slidably movable across said planar surface;

wherein said top layer being formed from an inelastic polymer matrix composite comprising at least a carbon fiber reinforced plastic or resin, said top layer including the planar surface and a surface adjacent to the planar surface, said adjacent surface being bent to form an angle with the planar surface so as to constitute a receiving surface for said medium as it moves toward and across said planar surface;

wherein said middle layer being formed from an elastic rubber; and wherein said bottom layer being formed from an inelastic thermosetting resin.

2. The platen according to claim 1, wherein said planar surface of the top layer is formed from the polymer matrix composite exhibiting a low surface coefficient of sliding friction to the print medium.

3. A printing apparatus comprising a printing medium, platen backing and supporting said medium, a print head mechanism for impressing marks on the medium by impacting said platen through the medium, and an arrangement for slidably moving the medium over the platen;

wherein said platen comprises a planar surface for supporting the print medium and comprising at least three contact layers including a top, middle, and bottom layer, said layers providing a mass tuned so as to energetically absorb repeated impacts from the print head;

wherein said top layer being formed from an inelastic polymer matrix composite comprising at least a carbon fiber reinforced plastic or resin, said top layer including the planar surface and a surface adjacent to the planar surface, said adjacent surface being bent to form an angle with the planar surface so as to constitute a receiving surface for said medium as it moves toward and across said planar surface;

wherein said middle layer being formed from an elastic rubber-like material; and wherein said bottom layer being formed from an inelastic thermosetting resin.

4. The printing apparatus according to claim 3, wherein said elastic rubber-like material forming said middle layer is selected from a set consisting of natural rubber, urethane rubber, silicone rubber, and vinyl chloride.

5. The printing apparatus according to claim 3, wherein the shape of the planar surface of said platen is selected from a set consisting of a substantially flat surface and a substantially convex surface.

6. The printing apparatus according to claim 3, wherein said planar surface of the top layer formed from the polymer matrix composite exhibits a low surface coefficient of sliding friction to the print medium.

* * * * *